US011329427B2

(12) United States Patent
Ichikawa

(10) Patent No.: US 11,329,427 B2
(45) Date of Patent: May 10, 2022

(54) CONNECTOR WITH LOCKING MECHANISM AND CONNECTOR DEVICE

(71) Applicant: Hirose Electric Co., Ltd., Yokohama (JP)

(72) Inventor: Kazunori Ichikawa, Yokohama (JP)

(73) Assignee: Hirose Electric Co., Ltd., Kanagawa (JP)

( * ) Notice: Subject to any disclaimer, the term of this patent is extended or adjusted under 35 U.S.C. 154(b) by 0 days.

(21) Appl. No.: 17/065,030

(22) Filed: Oct. 7, 2020

(65) Prior Publication Data

US 2021/0111514 A1 Apr. 15, 2021

(30) Foreign Application Priority Data

Oct. 11, 2019 (JP) ..... JP2019-187536

(51) Int. Cl.
*H01R 13/627* (2006.01)
*H01R 13/512* (2006.01)
*H01R 107/00* (2006.01)

(52) U.S. Cl.
CPC ..... *H01R 13/6273* (2013.01); *H01R 13/512* (2013.01); *H01R 2107/00* (2013.01)

(58) Field of Classification Search
CPC ..... H01R 13/512; H01R 13/6273; H01R 2107/00
USPC ..... 439/358
See application file for complete search history.

(56) References Cited

U.S. PATENT DOCUMENTS 5,158,473 A * 10/1992 Takahashi ..... H01R 13/641 439/353
5,197,901 A * 3/1993 Hashiguchi ..... H01R 13/6275 439/352
5,277,627 A * 1/1994 Matsuzaki ..... H01R 12/75 439/677
5,486,117 A * 1/1996 Chang ..... H01R 13/6275 439/353
5,580,268 A * 12/1996 Miyazawa ..... H01R 13/639 439/352

(Continued)

FOREIGN PATENT DOCUMENTS

JP 6513542 B2 5/2019

*Primary Examiner* — Abdullah A Riyami
*Assistant Examiner* — Vladimir Imas
(74) *Attorney, Agent, or Firm* — Procopio, Cory, Hargreaves & Savitch LLP

(57) ABSTRACT

Prior-art connectors require burdensome operations that involve connecting the male screws of the threaded retaining members mounted on an overmolded connector unit to the internal threads provided in a counterpart connector and tightening the screws by turning in order to prevent connector disengagement. In addition, repeatedly attaching and detaching the connector may create a problem by increasing the burden of such operations.

The present invention provides a connector and a connector device that allows for easy attachment to and detachment from a counterpart connector by providing a locking mechanism that automatically locks upon connection to a counterpart connector and that permits unlocking by depressing buttons in a connector that includes a connector unit provided in a distal end section of a cable and a housing that holds said connector unit inside and is equipped with a locking mechanism for locking to a counterpart connector.

11 Claims, 5 Drawing Sheets

(56) References Cited

U.S. PATENT DOCUMENTS

| | | | | |
|---|---|---|---|---|
| 6,071,141 | A * | 6/2000 | Semmeling | H01R 13/6275 439/353 |
| 6,250,943 | B1 * | 6/2001 | Castle | H01R 13/6273 439/352 |
| 6,257,914 | B1 * | 7/2001 | Comerci | H01R 13/6273 439/357 |
| 6,454,592 | B2 * | 9/2002 | Takagi | H01R 13/6275 439/378 |
| 6,702,602 | B2 * | 3/2004 | Wu | H01R 13/6275 439/352 |
| 7,140,917 | B1 * | 11/2006 | O'Halloran | H01R 13/508 439/607.02 |
| 7,625,212 | B2 * | 12/2009 | Du | H01R 13/6205 439/39 |
| 7,841,889 | B2 * | 11/2010 | Gerard | H01R 13/6272 439/358 |
| 7,850,476 | B2 * | 12/2010 | Good | H02S 40/36 439/358 |
| 8,152,557 | B2 * | 4/2012 | Blanton | H01R 13/6215 439/362 |
| 9,261,653 | B2 * | 2/2016 | Isenhour | G02B 6/3853 |
| 2008/0139005 | A1 * | 6/2008 | Guo | H01R 13/6205 439/39 |
| 2011/0111618 | A1 * | 5/2011 | Su | H01R 13/512 439/357 |
| 2017/0373432 | A1 * | 12/2017 | Chen | H01R 13/6273 |

* cited by examiner

CONNECTOR WITH LOCKING MECHANISM AND CONNECTOR DEVICE

CROSS-REFERENCE TO RELATED APPLICATIONS

This application claims priority to Japanese Patent Application No. 2019-187536, filed Oct. 11, 2019, the contents of which are incorporated herein by reference in its entirety for all purposes.

BACKGROUND

Technical Field

This invention relates to a connector which is capable of being retrofitted with a locking mechanism by attaching a housing equipped with a locking mechanism to an off-the-shelf (or overmolded) connector that lacks a locking mechanism for maintaining a connection with a counterpart connector.

Specifically, the invention relates to a connector with a locking mechanism that prevents disengagement of a USB (Universal Serial Bus) cable connector (plug connector) connected to a counterpart connector (receptacle connector) mounted to a board in a measurement instrument, a PLC (Programmable Logic Controller), or another device for the purpose of power supply, data communication, or the like, and that allows for easy attachment to and detachment from the counterpart connector.

Related Art

USB Type-C Standard-based connectors are used in electron microscopes, robotic arms, PLCs, and other devices for the purpose of power supply, data communication, or the like. When a plug connector provided at the distal end of a USB cable is connected to a receptacle connector provided in the enclosure of a device to which it is to be connected, the connection between the two connectors may be broken and the USB cable may be disengaged as a result of pulling the USB cable in a rearward direction or because of vibration or movement of the device to which it is to be connected.

For example, in the connector disclosed in Japanese Patent No. 6,513,542 (Patent Reference 1), in order to prevent such disengagement of a USB cable, threaded retaining members are mounted to the main body of the connector (an overmolded connector unit), and, when the connector is connected, male screw members in the threaded retaining members mounted to the connector main body are connected to internally threaded portions provided in the counterpart connector to which it is to be connected, thereby making it possible to prevent connector disengagement.

PATENT REFERENCES

[Patent Reference 1]
Japanese Patent No. 6,513,542.

SUMMARY

Technical Problems to be Solved

However, a problem arising with conventional connectors is that the operations of connecting the male screws of the threaded retaining members mounted to the overmolded connector unit to the internal threads provided in the counterpart connector and tightening the screws by turning every time the connector is connected in order to prevent inadvertent disengagement from the counterpart connector are burdensome, and such operations become particularly burdensome in applications involving frequent connector attachment and detachment.

In addition, another problem that may arise in the prior art is that since the threaded retaining members are secured in place by mounting on the main body of the connector, when the connector is connected to the counterpart connector, the positions of the screws and the screw holes end up misaligned as a consequence of slight shifts in the mounting positions of the threaded retaining members or slight differences in size, etc., due to individual differences between the connectors, and the operation of turning the screws to prevent disconnection of the connector cannot be readily accomplished.

In order to overcome such problems, there is provided a connector and a connector device that allows for easy attachment to and detachment from a connector by providing a locking mechanism that automatically locks upon connection to a counterpart connector and that permits unlocking by depressing buttons in a connector that includes a connector unit provided in a distal end section of a cable and a housing that holds said connector unit inside and is equipped with a locking mechanism for locking to a counterpart connector.

In addition, there is provided a connector and a connector device that allows for easy connection to a counterpart connector and that permits locking for the purpose of preventing disengagement from a counterpart connector in a manner unaffected by slight shifts in the mounting position of the connector unit within the housing or slight differences in the size of the connector unit and the housing by providing a gap between the connector unit held in the housing equipped with a locking mechanism and the inner walls of the housing and adapting the connector unit in the housing to slightly float within a motion range defined by said gap.

Technical Solution

A connector according to one embodiment of the present invention includes a connector unit having a raised mating portion and a housing that holds the connector unit and is equipped with locking members, the housing has the raised mating portion exposed in its central section in a direction of mating, the housing includes raised engaging portions that project in the direction of mating so as to sandwich the raised mating portion on opposite sides thereof, the locking members are equipped with locking pawls at the distal ends and are equipped with operative locking portions at the rear ends, the raised engaging portions have the locking pawls exposed thereon, a gap is provided between the connector unit and the inner walls of the housing facing the connector unit, and the connector unit is adapted to be capable of floating within the housing by virtue of the gap.

As a preferred embodiment of the inventive connector, the gap is provided around the periphery of the connector unit held in the housing, and the connector unit can move in any direction within a motion range defined by the gap.

As a preferred embodiment of the inventive connector, the locking pawls are exposed on the lateral faces of the raised engaging portions facing the raised mating portion of the connector unit and the locking pawls protrude in the direction of the raised mating portion.

As a preferred embodiment of the inventive connector, the locking pawls are exposed on the lateral faces opposite to the lateral faces of the raised engaging portions facing the raised mating portion of the connector unit and the locking pawls protrude in the direction opposite to the direction of the raised mating portion.

As a preferred embodiment of the inventive connector, the distal ends of the raised engaging portions and the distal end of the raised mating portion are substantially aligned in the direction of mating.

As a preferred embodiment of the inventive connector, the operative locking portions are exposed on the lateral faces of the housing and the locking pawls move in the width direction in response to depression of the operative locking portions.

As a preferred embodiment of the inventive connector, the connector unit is equipped with unit position regulating portions, the housing is equipped with housing position regulating portions, and the position of the connector unit within the housing is regulated by virtue of engagement of the unit position regulating portions with the housing position regulating portions.

As a preferred embodiment of the inventive connector, the locking members are disposed within the housing on opposite sides of the connector unit in the width direction.

As a preferred embodiment of the inventive connector, the locking members are equipped with resilient spring strips, the spring strips abut the inner walls of the housing, and, upon connection to a counterpart connector, automatically enter a locked state and maintain said state by virtue of the resilience of the spring strips.

As a preferred embodiment of the inventive connector, the connector unit conforms to the USB (Universal Serial Bus) Type-C Standard.

A counterpart connector according to one embodiment of the present invention, which is connected to the connector, is characterized by the fact that the counterpart connector includes a connector main body portion that has a recessed mating portion for mating with the raised mating portion and a counterpart housing that is a separate component from the counterpart connector and has recessed engagement portions for receiving the raised engaging portions, and the recessed engagement portions are equipped with locking apertures adapted to engage the locking pawls exposed on the raised engaging portions.

A connector device according to one embodiment of the present invention is characterized by including the connector and the counterpart connector.

Technical Effect

The connector and connector device according to the present invention make it possible for an overmolded connector unit to be retrofitted with a locking mechanism by attaching a housing equipped with a locking mechanism to a connector unit and allow for easy attachment to and detachment from a counterpart connector by providing the housing holding the connector unit with a locking mechanism that automatically locks upon connection to a counterpart connector and that permits unlocking by depressing buttons.

In addition, the inventive connector and connector device allows for easy attachment to and detachment from a counterpart connector in a manner unaffected by slight shifts in the mounting position of the connector unit within the housing and slight differences in the size of the connector unit and the housing by providing a gap between the connector unit held in the housing equipped with a locking mechanism and the inner walls of the housing and adapting the connector unit in the housing to slightly float within a motion range defined by said gap.

DETAILED DESCRIPTION

Figure 1:
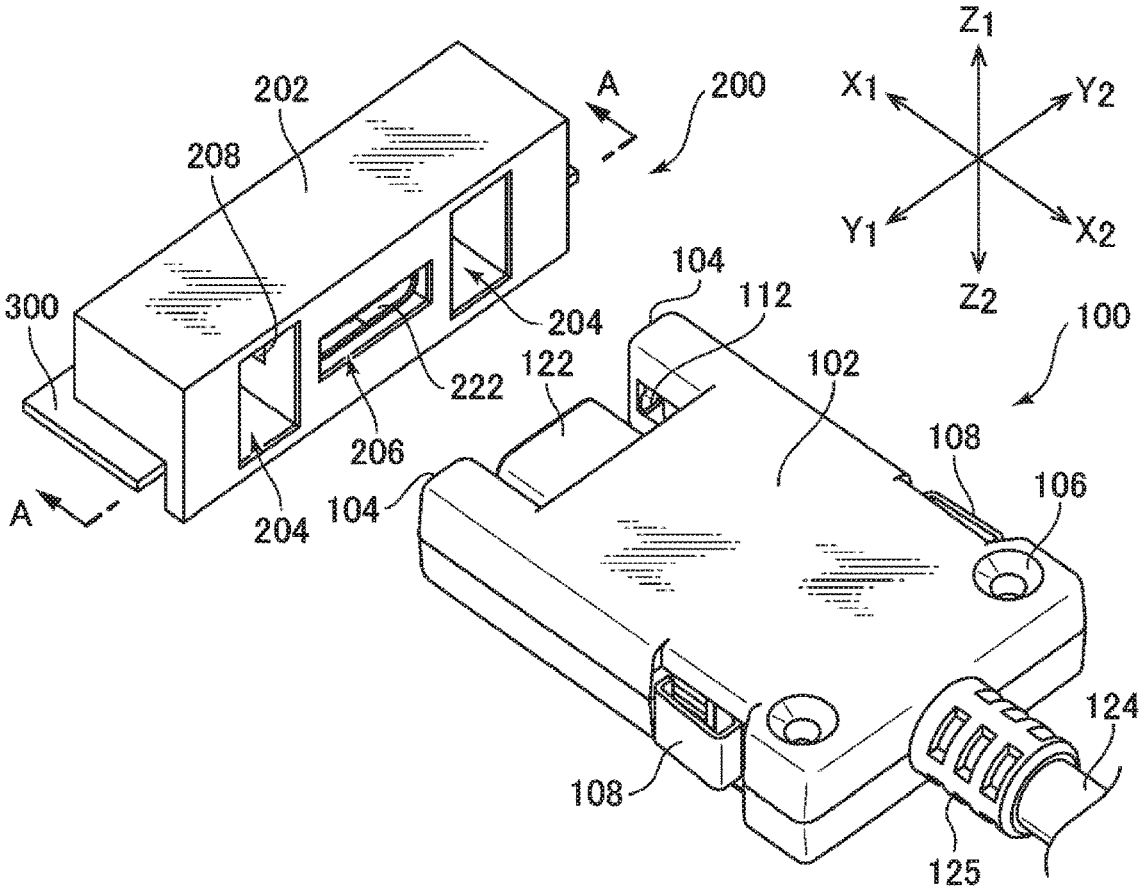
FIG. 1 illustrates a view illustrating a connector device that includes a connector and a counterpart connector according to one embodiment of the present invention.

Some embodiments of the invention are described below with reference to the drawings. It should be noted that, in principle, in all of the drawings illustrating the embodiments, like reference numerals are assigned to like parts and further description thereof is omitted. In addition, the fact that the respective embodiments are illustrated independently of one another does not preclude forming the connector as a combination of their respective components.

Figure 2:
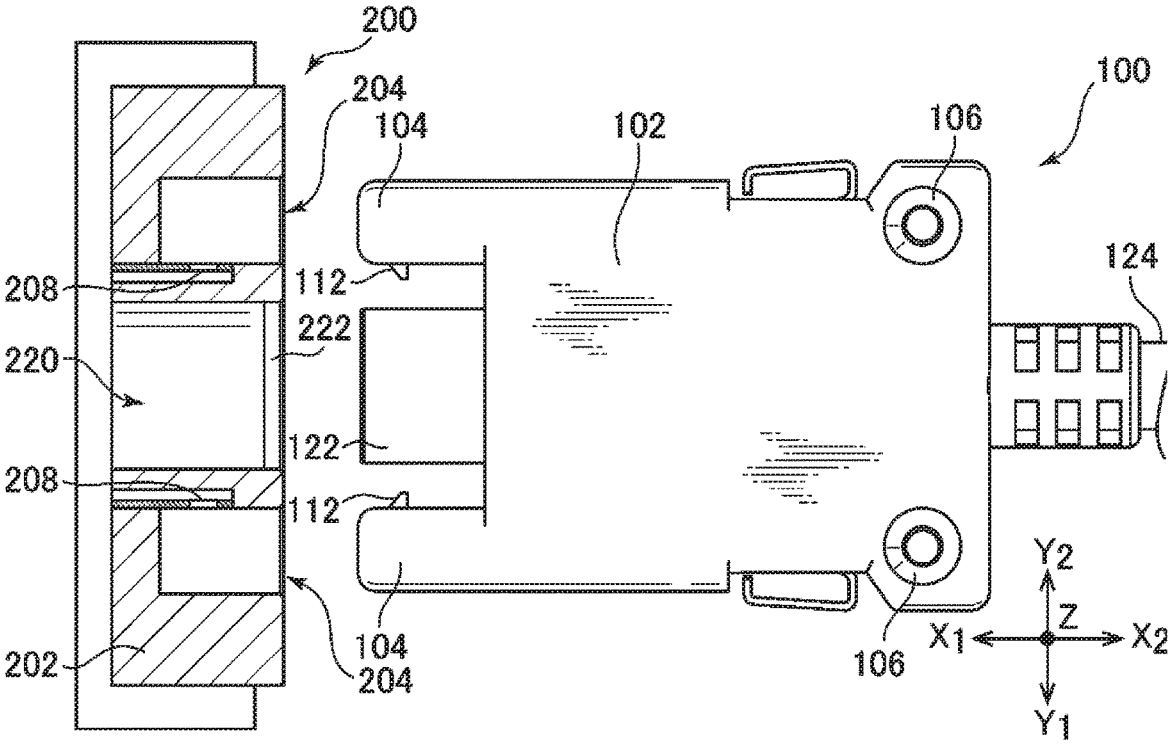
FIG. 2 illustrates a cross-sectional view of the counterpart connector taken along line A-A shown in FIG. 1 in the direction of mating.

FIG. 1 illustrates a connector device that includes a connector and a counterpart connector according to one embodiment of the present invention. In addition, FIG. 2 illustrates a cross-section of the counterpart connector only taken along line A-A shown in FIG. 1 in the direction of mating. In the discussion below, the mating or longitudinal direction of the connector 100 and the counterpart connector 200 is the $X_1$-$X_2$ direction (X-axis direction), and the width direction is the $Y_1$-$Y_2$ direction (Y-axis direction) indicated the drawings. In addition, the vertical direction of the connector 100 and the counterpart connector 200 is the $Z_1$-$Z_2$ direction (Z-axis direction). The foregoing is equally applicable to other drawings.

The connector 100 is connected to the counterpart connector 200, which serves as a receptacle connector and is located on side $X_1$ in the X-axis direction. The connector 100 includes a substantially rectangular housing 102, which is used to hold the hereinafter-described connector unit 120 (see FIG. 3), a raised mating portion 122, which is the outer conductor shell of the connector unit 120, i.e. the plug connector, and is exposed from the housing 102 in the direction of mating (X-axis direction), raised engaging portions 104, which project in the direction of mating (X-axis direction) on opposite sides (side $Y_1$ and side $Y_2$) of the raised mating portion 122 so as to sandwich the raised mating portion 122 in the width direction (Y-axis direction), and operative locking portions 108 on the lateral faces of the connector 100 in the width direction (Y-axis direction). The distal ends of the raised engaging portions 104 and the distal end of the raised mating portion 122 are substantially aligned in the direction of mating (X-axis direction) (see FIG. 2).

The connector 100 is provided with a cable 124 extending from the lateral face of the housing 102 located on the side (side $X_2$) that is opposite to the side (side $X_1$) on which the raised mating portion 122 is exposed. A molded cable portion 125 is provided at the boundary between the housing 102 and the cable 124. The housing 102 has screw holes 106 provided in its surface at the rear end (on side $X_2$) in the longitudinal direction (X-axis direction) for securing the housing 102 to the connector unit 120 (see FIG. 3) by inserting screws in the vertical direction.

The raised engaging portions 104 of the connector 100 have locking pawls 112 exposed on the lateral faces that face the raised mating portion 122, with said locking pawls 112 protruding in the direction of the raised mating portion 122. The locking pawls 112 and the raised engaging portions 104 are not limited to the embodiment illustrated in FIG. 1 and, with the locking pawls 112 oriented in opposite directions, the locking pawls 112 may be adapted to be exposed on the lateral faces opposite to the lateral faces of the raised engaging portions 104 facing the raised mating portions 122, while the locking pawls 112 may be adapted to protrude in the direction opposite to the direction of the raised mating portions 122.

The counterpart connector 200 has a connector main body portion 220, which serves as a receptacle connector, and a counterpart housing 202, which is disposed on the outside of the connector main body 220. The connector main body portion 220 has a recessed mating portion 222 used for mating with the raised mating portion 122 of the connector 100. The counterpart housing 202 includes an opening 206, which is provided in its lateral face in the direction of mating (X-axis direction) and exposes the recessed mating portion 222, and recessed engagement portions 204, which are provided on opposite sides (side $Y_1$ and side $Y_2$) of the recessed mating portion 222 in the width direction (Y-axis direction) and are used to receive the raised engaging portions 104 of the connector 100. When the connector 100 and the counterpart connector 200 are connected, the raised mating portion 122 of the connector unit 120 fits into the recessed mating portion 222 of the connector main body portion 220 exposed from the opening 206 of the housing 202.

The counterpart connector 200 is mounted by soldering or the like to a board 300 provided in a measurement instrument, a PLC, or another device, and, in particular, since the connector main body portion 220 and the housing 202 are separate components, they are individually mounted to the board 300. The recessed engagement portions 204 are formed in the counterpart housing 202 and locking apertures 208, which are adapted to engage the locking pawls 112 that protrude from the lateral faces of the raised engaging portions 104, are provided in the inner walls of the recessed engagement portions 204. The locations where the locking apertures 208 are provided can be changed as appropriate to match the locations where the locking pawls 112 are provided. In the event that, with the locking pawls 112 oriented in opposite directions, the locking pawls 112 are exposed from the lateral faces opposite to the lateral faces of the raised engaging portions 104 facing the raised mating portion 122 and are adapted to protrude in the direction opposite to the direction of the raised mating portions 122, the locking apertures 208 can be provided on the (outer) sides opposite to the (inner) sides proximate to the recessed mating portion 222. The locking apertures 208 may be provided as part of the counterpart housing 202 or, alternatively, may be provided as members separate from the main body section of the counterpart housing 202.

While both the raised engaging portions 104 and the recessed engagement portions 204 are formed to be rectangular in shape in a plane (Y-Z plane) perpendicular to the direction of mating (X-axis direction), their shape is not limited to the above and may be a polygonal, tubular, or another shape in which the locking pawls 112 and the locking apertures 208 function as a locking mechanism.

Figure 3:
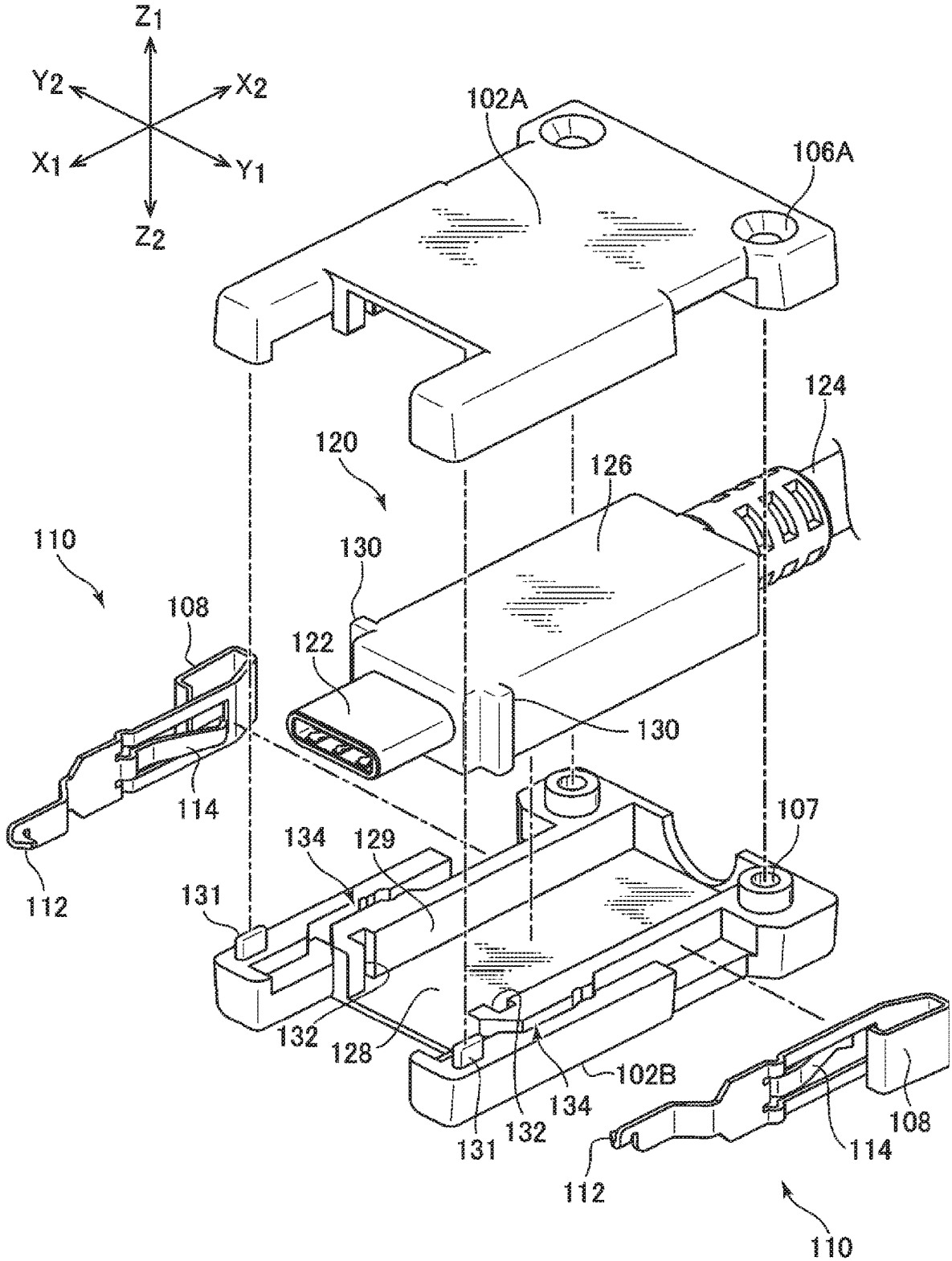
FIG. 3 illustrates a view illustrating the components that form a connector according to one embodiment of the present invention.
Figure 4:
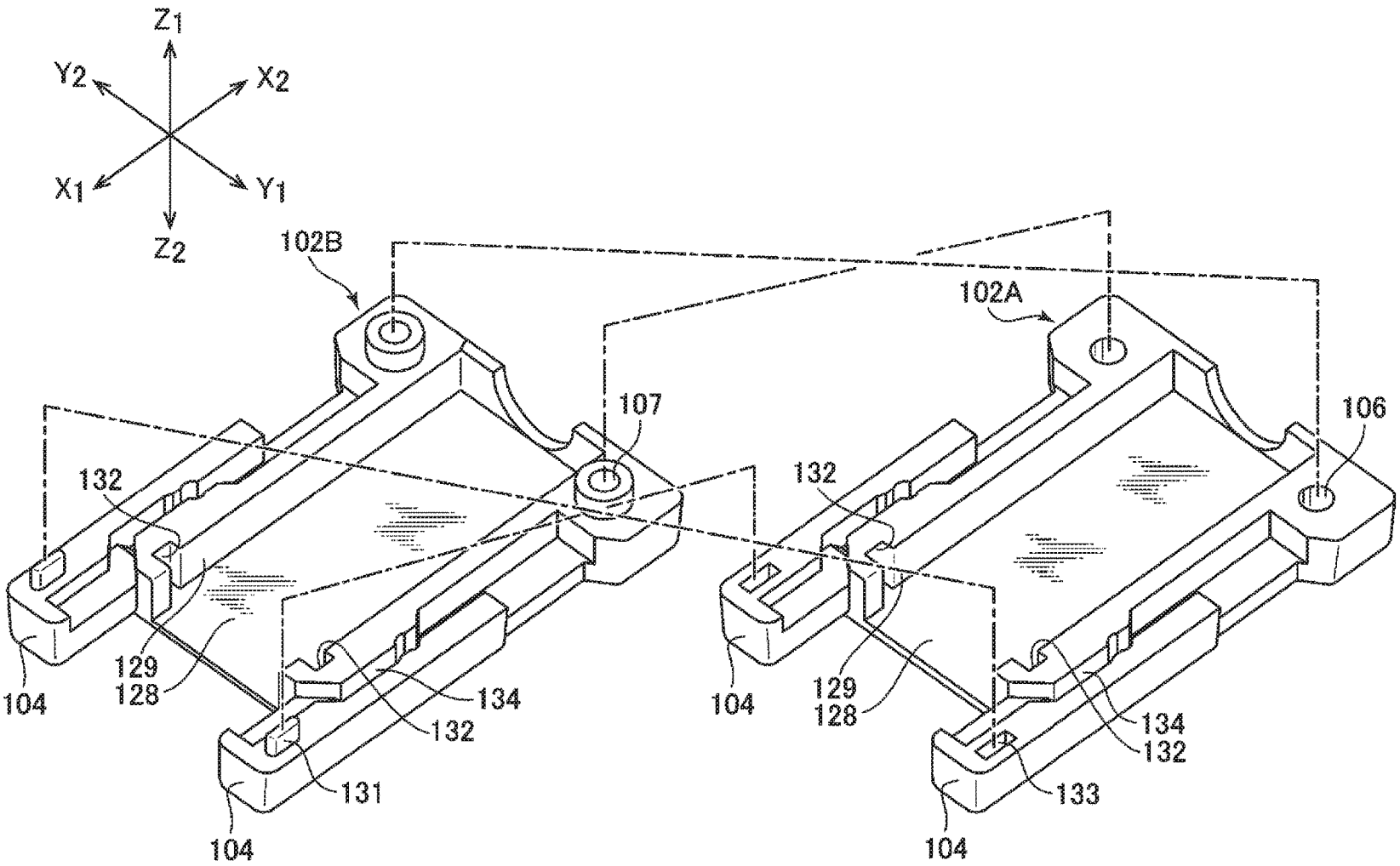
FIG. 4 illustrates a view illustrating a housing that holds a connector unit.

FIG. 3 illustrates the components that form a connector according to one embodiment of the present invention and FIG. 4 illustrates a housing that holds a connector unit. The components forming the connector 100 include a housing 102 comprising a first housing 102A and a second housing 102B, a connector unit 120 held in the housing 102, and locking members 110 disposed within the housing 102 on opposite sides (side $Y_1$ and side $Y_2$) of the connector unit 120 in the width direction (Y-axis direction).

Figure 5:
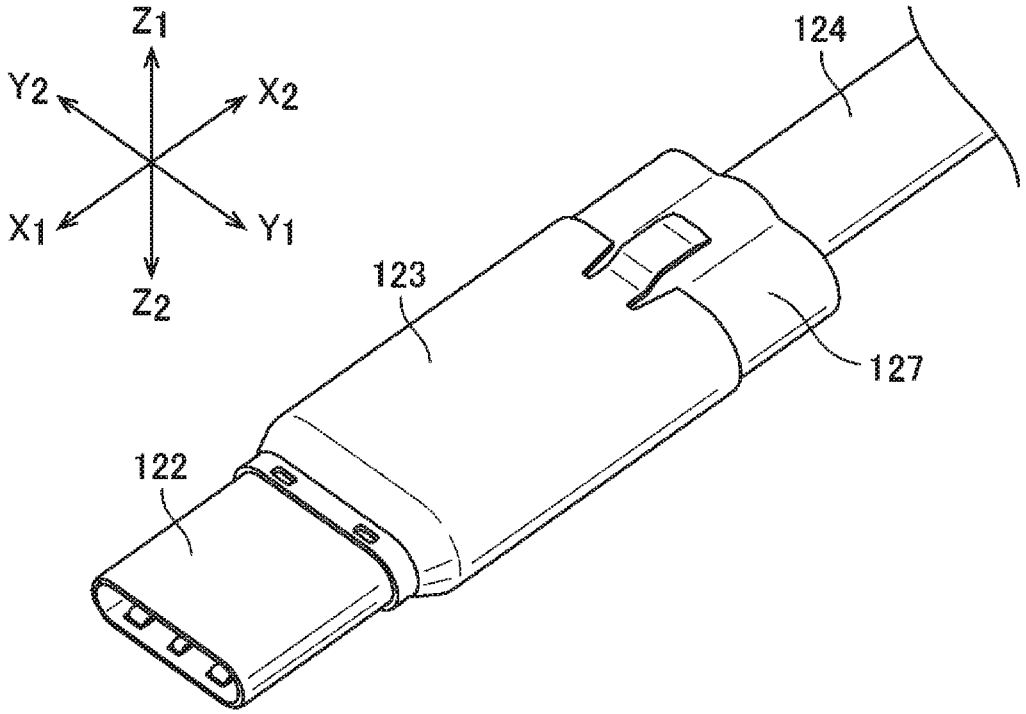
FIG. 5 illustrates a view illustrating the connector unit before overmolding.
Figure 6:
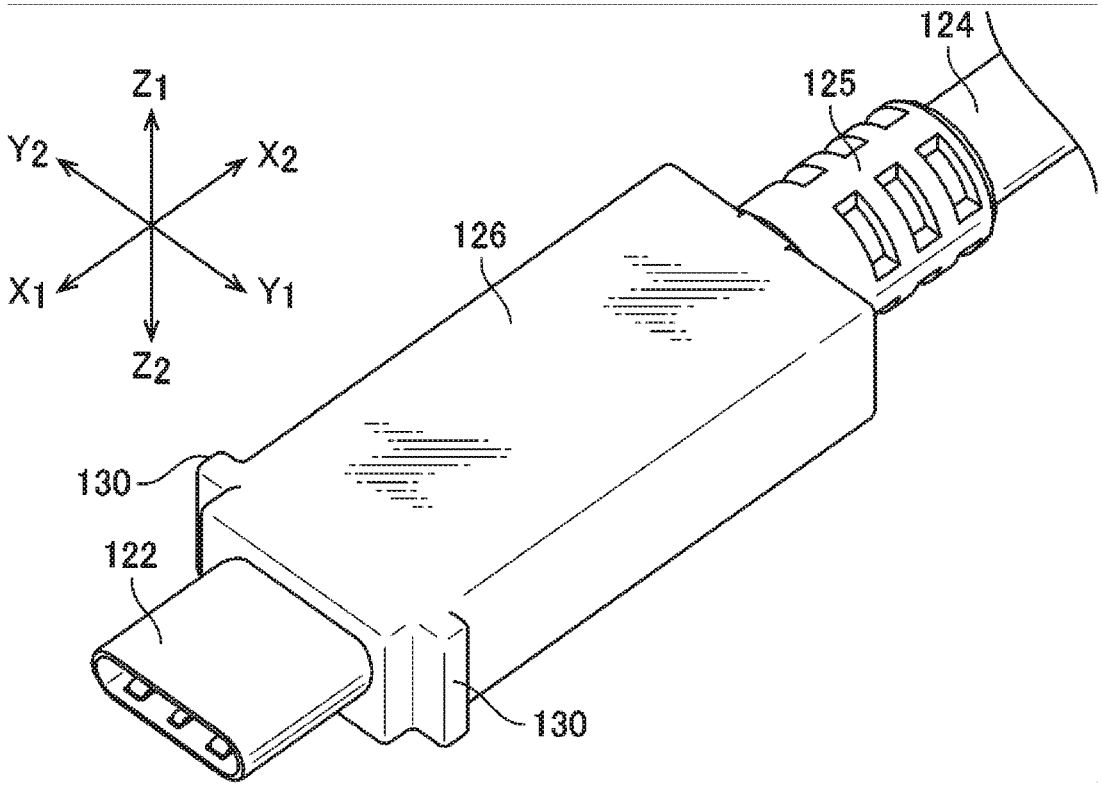
FIG. 6 illustrates a view illustrating the connector unit after overmolding.

The connector unit 120 includes a plastic molded portion 126 encapsulating an internal circuit board and a junction section between said board and a cable 124, and the raised mating portion 122 is located at the distal end (on side $X_1$) of the plastic molded portion 126. FIG. 5 shows the connector unit before overmolding and FIG. 6 shows the connector unit after overmolding. A connector unit that conforms, for example, to the USB (Universal Serial Bus) Type-C Standard can be used as the connector unit 120.

Referring now to FIGS. 5 and 6 in addition to FIGS. 3 and 4, in order from front (side $X_1$) to rear (side $X_2$) in the direction of mating (X-axis direction), the connector unit 120 before overmolding includes a raised mating portion 122, a tubular portion 123 coupled to the raised mating portion 122, and a cable connection portion 127 coupled to the tubular portion 123. The raised mating portion 122, tubular portion 123, and cable connection portion 127 respectively constitute an outer conductor shell. The tubular portion 123 and the cable connection portion 127 can protect the circuit board (not shown) of the connector connected to the cable 124, and the surface of the tubular portion 123 and the cable connection portion 127 is encapsulated by overmolding with an insulating plastic material, thereby forming a plastic molded portion 126 in the shape of a rectangular parallelepiped. Although the plastic molded portion 126 is formed in the shape of a rectangular parallelepiped that extends in the longitudinal direction (X-axis direction), its shape is not limited to the above and may be a tubular, polygonal, or other shape.

The connector unit 120 includes raised position regulating portions (unit position regulating portions) 130 that protrude from the opposite lateral faces (on side $Y_1$ and side $Y_2$) in the width direction (Y-axis direction) of the plastic molded portion 126 and are formed in the shape of ridges in the vertical direction (Z-axis direction). Turning now to FIG. 4 in addition to FIG. 3, the basic structure of the first housing 102A and the second housing 102B contained in the housing 102 is the same. The first housing 102A and the second housing 102B include, respectively, a unit holding portion 128 for holding the plastic molded portion 126 of the connector unit 120, and recessed position regulating portions (housing position regulating portions) 132 formed in the shape of grooves in the vertical direction (Z-axis direction) by making indents in the inner walls 129 facing the unit holding portion 128. The position of the connector unit 120 within the housing 102 can be regulated by virtue of engagement of the raised position regulating portions 130 with the recessed position regulating portions 132.

The raised positioning regulating portions 130 and the recessed positioning regulating portions 132 can also be formed as negative replicas of the recessed and raised portions. In other words, the unit position regulating portions (130) can be formed in the shape of grooves in the vertical direction (Z-axis direction) and the housing positioning regulating portions (132) can be formed in the shape of ridges in the vertical direction (Z-axis direction).

When the connector 100 is assembled by placing the connector unit 120 along with the locking members 110 in the unit holding portion 128, the raised positioning regulating portions 130 are fitted into the recessed positioning regulating portions 132 provided in the inner walls 129 facing the unit holding portion 128 of the housing 102 (first housing 102A, second housing 102B). The screw holes 106 provided proximate the corners in the rear (on side $X_2$) of the first housing 102A are then superposed upon the screw holes 107 provided in the vicinity of the corners in the rear (on side $X_2$) of the second housing 102B and fastened with screws. On the other hand, the raised nesting portions 131 provided in the vicinity of the corners in the front (on side $X_1$) of the second housing 102B are fitted into the recessed nesting portions 133 provided in the vicinity of the corners in the front (on side $X_1$) of the first housing 102A. In such a configuration, the first housing 102A and the second housing 102B are secured in place by fastening with screws. The fastening together of the first housing 102A and the second housing 102B is not limited to the above and can be accomplished without screws via press-fitting, by providing a plurality of recessed nesting portions and raised nesting portions.

Figure 7:
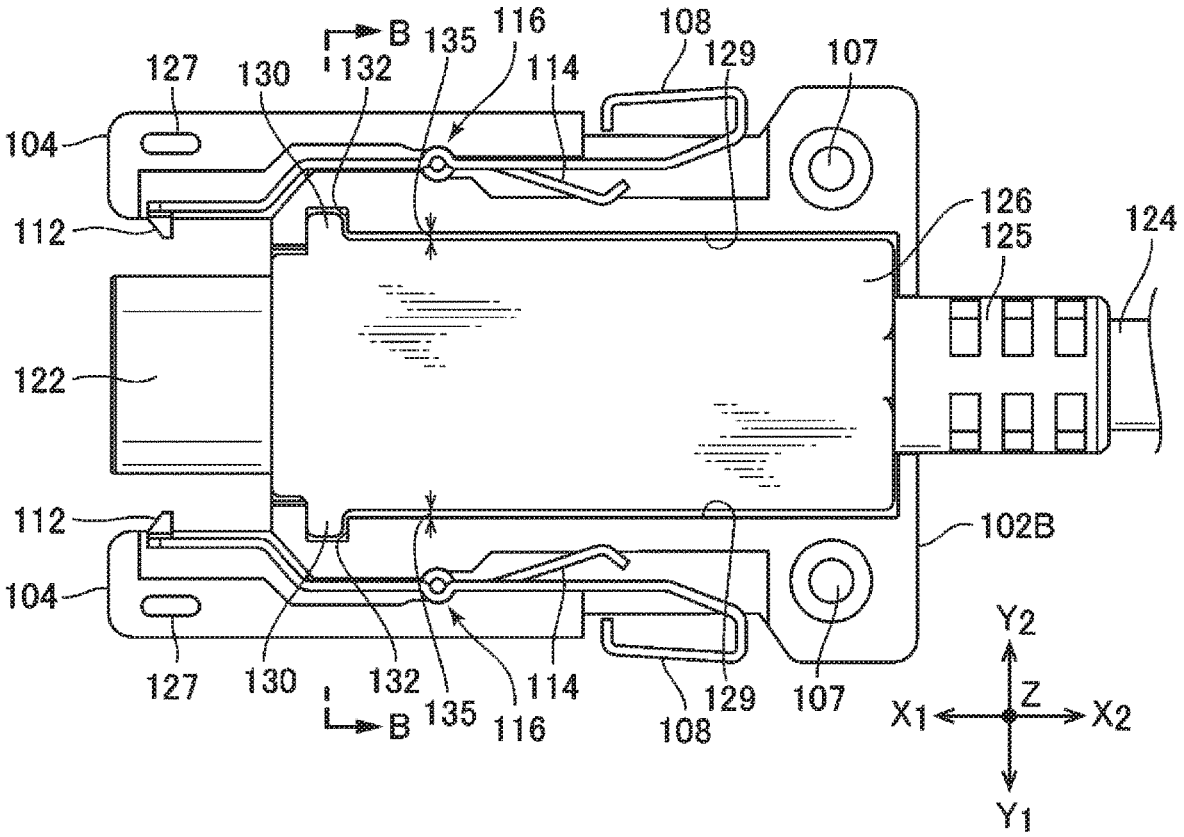
FIG. 7 illustrates a top view of the connector in the vertical direction (Z-axis direction), with one housing removed.

FIG. 7 illustrates the top face of the connector as viewed in the vertical direction (Z-axis direction), with one housing removed. Referring now to FIG. 7 along with FIG. 3, the locking members 110 are equipped with locking pawls 112 at the distal ends (on side $X_1$) in the longitudinal direction (X-axis direction) and are equipped with operative locking portions at the rear ends (on side $X_2$). In addition, the locking members 110 are equipped with resilient spring strips 114 that project from the central section toward the rear end (on side $X_2$). The locking members 110 are held in locking member holding portions 134 and are disposed within the housing 102 on opposite sides (side $Y_1$ and side $Y_2$) in the width direction (Y-axis direction) of the connector unit 120.

By using fulcrums 116 as rotational axes, the locking members 110 can move the locking pawls 112 in the width direction (Y-axis direction) in response to depression of the operative locking portions 108. The spring strips 114 abut the inner walls of the housing 102 (second housing 102B in FIG. 7) and, upon connection to the counterpart connector 200, the locking members 110 can automatically enter a locked state and maintain this state by virtue of the resilience of the spring strips 114.

More specifically, the locking pawls 112 protrude from the lateral walls of the raised engaging portions 104 when the operative locking portions 108 are not actuated (depressed) and, upon connection to the counterpart connector 200, the locking pawls 112 are depressed by the inner walls of the recessed engagement portions 204. Once the raised engaging portions 104 have been inserted all the way into the recessed engagement portions 204, the locking pawls 112 fit into and engage the locking apertures 208 by virtue of the resilience of the spring strips 114. When the locking pawls 112 are engaged with the locking apertures 208, the connection between the connector 100 and the counterpart connector 200 is locked. When the operative locking portions 108 are depressed, the locking pawls 112 are disengaged from the locking apertures 208 and contained within the lateral walls of the raised engaging portions 104, thereby allowing for the connection between the connector 100 and the counterpart connector 200 to be broken. In this manner, the locking pawls 112 and the locking apertures 208 operate as a locking mechanism (a so-called one-touch locking mechanism).

According to the invention, when the one-touch locking mechanism is used, the positional relationship used for locking the locking pawls 112 and the locking apertures 208 needs to be set exactly for the locking pawls 112 to fit precisely into the locking apertures 208.

In addition, the positional relationship used for mating the raised mating portion 122 and the counterpart connector 200 needs to be set exactly for the raised mating portion 122 of the connector 100 to be precisely mated with the counterpart connector 200.

However, setting both the locking positional relationship and the mating positional relationship in an exact manner is difficult and the following situations are likely to occur if either positional relationship is irregular: (1) the locking of the locking pawls 112 and the locking apertures 208 can be achieved, but the raised mating portion 122 of the connector 100 will not mate with the recessed mating portion 222 of the connector main body portion 220, (2) the raised mating portion 122 can be mated with the recessed mating portion 222, but cannot be locked, or (3) neither locking, nor mating can be accomplished. The likelihood of such difficulties increases if the positional relationship of the connector main body portion 220 and the counterpart housing 202 is irregular.

Figure 8:
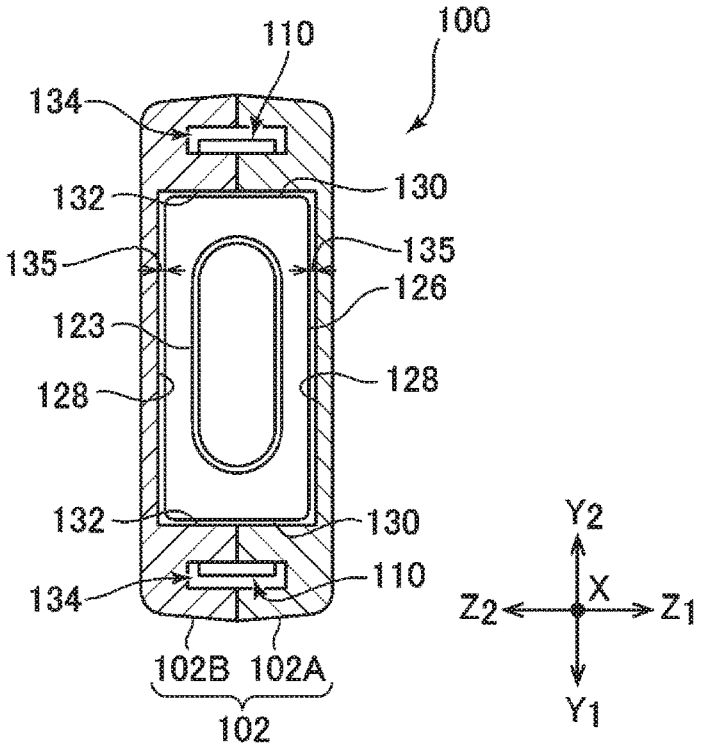
FIG. 8 illustrates a cross-sectional view of the connector taken along line B-B shown in FIG. 7 in the vertical direction (Z-axis direction).

FIG. 8 illustrates a cross-section of the connector taken along line B-B shown in FIG. 7 in the vertical direction (Z-axis direction). Turning now to FIG. 8 along with FIG. 7, in order to eliminate the above-described difficulties, a gap 135 is provided between the connector unit 120 and the surrounding inner walls (unit holding portion 128, inner walls 129, etc.) of the housing 102 facing the connector unit 120. By virtue of the gap 135 provided around its periphery, the connector unit 120 is capable of floating floating within the housing 102. More specifically, the connector unit 120 is capable of moving in any direction, that is, in the X-axis direction, Y-axis direction, or Z-axis direction within a motion range defined by the gap 135.

In the present invention, the above configuration enables the connector unit 120 to move (float) in any direction relative to the housing 102, thereby making it possible to reliably accomplish precise fitting of the locking pawls 112 into the locking apertures 208, as well as mating of the raised mating portion 122 of the connector 100 with the recessed mating portion 222 of the connector main body portion 220, and thus eliminate the above-described difficulties.

In addition, the present invention allows for easy attachment to and detachment from the counterpart connector 200 by providing the housing 102 holding the connector unit 120 with a locking mechanism that automatically locks upon connection to the counterpart connector 200 and permits unlocking by depressing buttons, that is, the operative locking portions 108. On the other hand, the connection between the connector 100 and the counterpart connector 200 cannot be inadvertently broken because unlocking is impossible without depressing the operative locking portions 108.

Furthermore, this invention allows for easy attachment to and detachment from the counterpart connector 200 in a manner unaffected by slight shifts in the mounting position of the connector unit 120 within the housing 102 and slight differences in the size of the connector unit 120 and the housing 102.

INDUSTRIAL APPLICABILITY

The inventive connector facilitates attachment to and detachment from a counterpart connector (receptacle connector) mounted to a board in a measurement instrument, PLC, or another device and can be used for applications such as preventing a connector (plug connector) connected for the purpose of power supply, data communication, or the like from being disengaged upon connection to a counterpart connector.

DESCRIPTION OF THE REFERENCE NUMERALS

100. Connector
102. Housing (plug housing)
102A. First housing
102B. Second housing
104. Raised engaging portion
106. Screw hole
107. Screw hole
108. Operative locking portion
110. Locking member
112. Locking pawl
114. Spring strip
116. Fulcrum
120. Connector unit (plug connector)
122. Raised mating portion
123. Tubular portion
124. Cable
125. Molded cable portion
126. Plastic molded portion
127. Cable connection portion
128. Unit holding portion
129. Inner wall
130. Raised position regulating portion (unit position regulating portion)
131. Raised nesting portion
132. Recessed position regulating portion (housing position regulating portion)
133. Recessed nesting portion
134. Locking member holding portion
135. Gap
200. Counterpart connector
202. Counterpart housing (receptacle housing)
204. Recessed engagement portion
206. Opening
208. Locking aperture
220. Connector main body portion (receptacle connector)
222. Recessed mating portion
300. Board

The invention claimed is:

1. A connector, comprising:
a connector unit comprising a raised mating portion; and
a housing that holds the connector unit and is equipped with locking members, the housing comprising a first housing case, a second housing case, and housing position regulating portions disposed on the first housing and the second housing case, wherein
the raised mating portion is exposed by the housing in a central section in a direction of mating,
the housing comprising raised engaging portions that project in the direction of mating so as to sandwich the raised mating portion on opposite sides thereof,
the locking members comprising locking pawls at the distal ends and operative locking portions at the rear ends,
the raised engaging portions have the locking pawls exposed thereon,
a gap is provided between the connector unit and the inner walls of the housing facing the connector unit, and
the connector unit is configured to float within the housing by virtue of the gap.

2. The connector according to claim 1, wherein
the gap is provided around the periphery of the connector unit held in the housing and
the connector unit can move in any direction within a motion range defined by the gap.

3. The connector according to claim 1, wherein
the locking pawls are exposed on the lateral faces of the raised engaging portions facing the raised mating portion of the connector unit and
the locking pawls protrude in the direction of the raised mating portion.

4. The connector according to claim 1, wherein
the locking pawls are exposed on the lateral faces opposite to the lateral faces of the raised engaging portions facing the raised mating portion of the connector unit and
the locking pawls protrude in the direction opposite to the direction of the raised mating portion.

5. The connector according to claim 1, wherein
the distal ends of the raised engaging portions and the distal end of the raised mating portion are substantially aligned in the direction of mating.

6. The connector according to claim 1, wherein
the operative locking portions are exposed on the lateral faces of the housing and
the locking pawls move in the width direction in response to depression of the operative locking portions.

7. The connector according to claim 1, wherein
the connector unit comprises unit position regulating portions,
and
the position of the connector unit within the housing is regulated by virtue of engagement of the unit position regulating portions with the housing position regulating portions.

8. The connector according to claim 1, wherein
the locking members are disposed within the housing on opposite sides of the connector unit in the width direction.

9. The connector according to claim 1, wherein
the locking members comprises resilient spring strips,
the spring strips abut the inner walls of the housing, and, upon connection to a counterpart connector, automatically enter a locked state and maintain said state by virtue of the resilience of the spring strips.

10. The connector according to claim 1, wherein the connector unit conforms to the USB (Universal Serial Bus) Type-C Standard.

11. A system comprising:
a connector, comprising:

a connector unit comprising a raised mating portion; and a housing that holds the connector unit and is equipped with locking members, the housing comprising a first housing case, a second housing case, and housing position regulating portions disposed on the first housing case and the second housing case, wherein the raised mating portion is exposed by the housing in a central section in a direction of mating, the housing comprising raised engaging portions that project in the direction of mating so as to sandwich the raised mating portion on opposite sides thereof, the locking members comprising locking pawls at the distal ends and operative locking portions at the rear ends, the raised engaging portions have the locking pawls exposed thereon, a gap is provided between the connector unit and the inner walls of the housing facing the connector unit, and the connector unit is configured to float within the housing by virtue of the gap and a counterpart connector connected to the connector, the counterpart connector comprising:

a connector main body portion that has a recessed mating portion for mating with the raised mating portion;

a counterpart housing that is a separate component from the counterpart connector and has recessed engagement portions for receiving the raised engaging portions, and the recessed engagement portions are equipped with locking apertures adapted to engage the locking pawls exposed on the raised engaging portions.

* * * * *